United States Patent [19]

Miller

[11] Patent Number: 4,945,664

[45] Date of Patent: Aug. 7, 1990

[54] AMMUNITION MAGAZINE HOUSING ASSEMBLY

[75] Inventor: Michael K. Miller, Bakersfield, Calif.

[73] Assignee: AmerInd, Inc., Cleveland, Ohio

[21] Appl. No.: 446,340

[22] Filed: Dec. 5, 1989

[51] Int. Cl.[5] ..... F41A 9/75

[52] U.S. Cl. ..... 42/49.01

[58] Field of Search ..... 42/49.01, 50

[56] References Cited

U.S. PATENT DOCUMENTS

| | | |
|---|---|---|
| 726,562 | 4/1903 | Offutt . |
| 1,129,884 | 3/1915 | Mauser . |
| 3,577,860 | 5/1971 | Jestrabek . |
| 4,676,137 | 6/1987 | Stockton et al. . |
| 4,738,183 | 4/1988 | Miller et al. . |
| 4,766,800 | 8/1988 | Miller et al. . |
| 4,888,898 | 12/1989 | Miller et al. . |

*Primary Examiner*—Charles T. Jordan

*Assistant Examiner*—Richard W. Wendtland

*Attorney, Agent, or Firm*—Roylance, Abrams, Berdo & Goodman

[57] ABSTRACT

An improved magazine housing assembly for quickly assembling and disassembling the magazine. The magazine housing assembly includes first and second elongated housing halves, a first elongated clip for slideably engaging a first dovetail formed by the housing halves and a second elongated clip for slideably engaging a second dovetail formed by the housing halves. The improvement being that the first dovetail has a substantially continuous dovetail half on one of the housing halves and a segmented dovetail half on the other of the housing halves, which is slideably engaged by the first elongated clip having a continuous retaining ledge and a segmented retaining ledge. Accordingly, this arrangement permits the first elongated clip to be attached to or removed from the first dovetail without having to slide the first clip the entire length of the first dovetail.

20 Claims, 3 Drawing Sheets

FIG.1
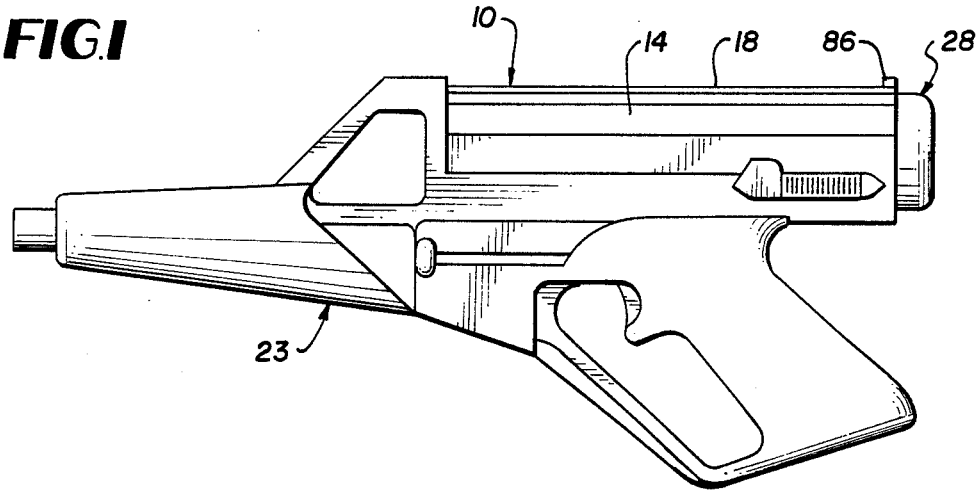
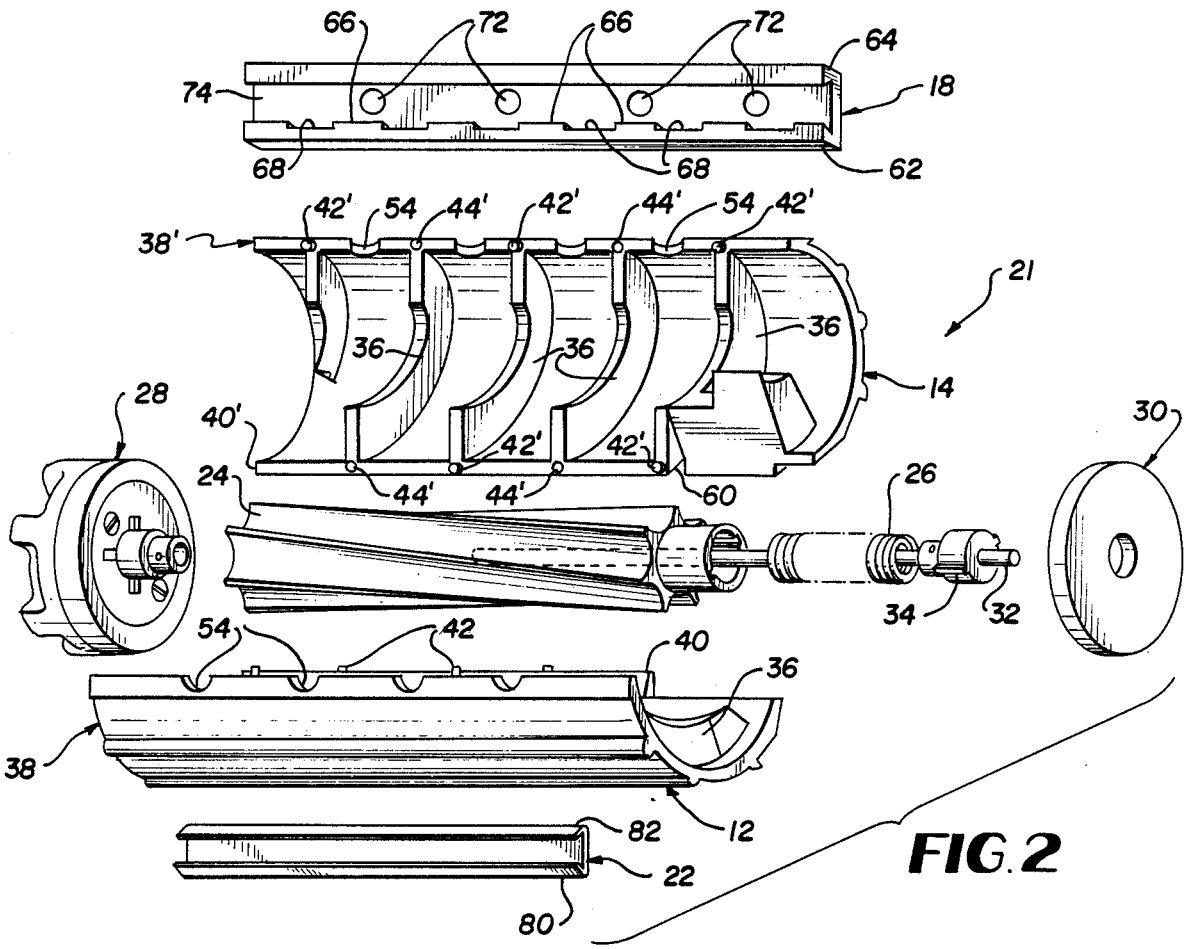
FIG.2

AMMUNITION MAGAZINE HOUSING ASSEMBLY

RELATED PATENTS

This application is related to U.S. Pat. Nos. 4,676,137; 4,766,800 and 4,738,183; all in the name of applicant above and a co-inventor, the entire disclosures of which are hereby incorporated by reference as if here set forth in full.

FIELD OF THE INVENTION

The invention relates to an ammunition magazine for a gun. More particularly, the invention relates to a housing assembly for such a magazine having a segmented elongated clip and mating dovetail for releasably holding together the housing halves of the ammunition magazine.

BACKGROUND OF THE INVENTION

An ammunition magazine having an elongated housing that comes apart into two substantially symmetrical halves is known in the prior U.S. Pat. No. 4,738,183. This patent discloses an ammunition magazine wherein the halves of the magazine housing are held together by a pair of elongated clips which fit into dovetail grooves along the mating edges of the housing halves. The magazine includes clear plastic window inserts positioned between semicircular openings between the housing halves. One elongated clip contains circular openings that align with the windows to permit viewing of the contents of the magazine.

A housing such as that described in U.S. Pat. No. 4,738,183 has the disadvantage that the clip must be slid down the entire length of the magazine in order to be removed, a procedure which may be awkward in an emergency situation such as a battlefield where the magazine housing may have to be quickly disassembled for repair. It is desirable therefore to have a clip that is quickly and easily removable and quickly and easily replaceable.

Further, it is desirable to have a elongated clip that is formed of a material such as plastic that is easily manufactured and can be easily molded to include window openings and other features such as part of a gun sight. Further, it is desirable to have an ammunition magazine that does not require numerous additional parts such as small plastic window inserts to allow viewing of the interior of the magazine.

SUMMARY OF THE INVENTION

Accordingly, a primary object of the present invention is to provide an ammunition magazine with housing halves that can be easily and quickly assembled and disassembled.

A further object of the invention is to provide an ammunition magazine that allows viewing the inside of the magazine housing without requiring additional window inserts.

A further object is to provide an ammunition magazine wherein the housing halves are held together by a plastic clip that is easy to manufacture.

The foregoing objects and other advantages are attained by providing an axially elongated hollow housing assembly for use in an ammunition magazine for a gun, the combination comprising a pair of housing halves substantially symmetrical in their outside configuration about a plane containing the longitudinal axis of the housing, and a dovetail extending along substantially the entire length of the housing having a first dovetail half on one of the housing halves and a second dovetail half on the other of the housing halves. One dovetail half has segments and cutouts spaced alternately and longitudinally apart. An elongated clip is provided having a first elongated ledge that fits around the first dovetail half, and a second elongated ledge that fits around the second dovetail half. The second elongated ledge has ledge segments and ledge cutouts spaced alternately and longitudinally apart. The dovetails cooperate with the clip so that the clip can be moved to and from locked and unlocked positions. In the unlocked position, the ledge segments align with the dovetail cutouts and the ledge cutouts align with the dovetail segments, allowing attachment or detachment of the clip to the dovetails during assembly or disassembly of the housing. In the locked position, the ledge segments align with the dovetail segments to hold the housing halves in the assembled together condition of the housing. The housing also includes a second dovetail and second clip on the opposite side of the housing. This second clip is plain like its counterpart in my prior patent 4,738,183.

The housing halves each contain complementary semicircular notches that together form circular openings in the assembled together condition of the housing to allow viewing of the contents of the housing when aligned with corresponding circular holes on the first elongated clip. A strip of clear plastic glued to the inside of the first elongated clip covers the circular housing openings in the assembled together condition of the housing.

Other objects, advantages and salient features of the invention will become apparent from the following detailed description, which, taken in conjunction with the annexed drawings, discloses the preferred embodiment of the invention.

BRIEF DESCRIPTION OF THE DRAWINGS

Referring now to the drawings which form part of this disclosure:

FIG. 1 is a side elevational view of a gun and an ammunition magazine utilizing a hollow housing assembly in accordance with the present invention;

FIG. 2 is a partial exploded view of the magazine of the present invention, with some parts turned by 90° to better show certain features;

DETAILED DESCRIPTION OF THE PREFERRED EMBODIMENT

Figure 3:
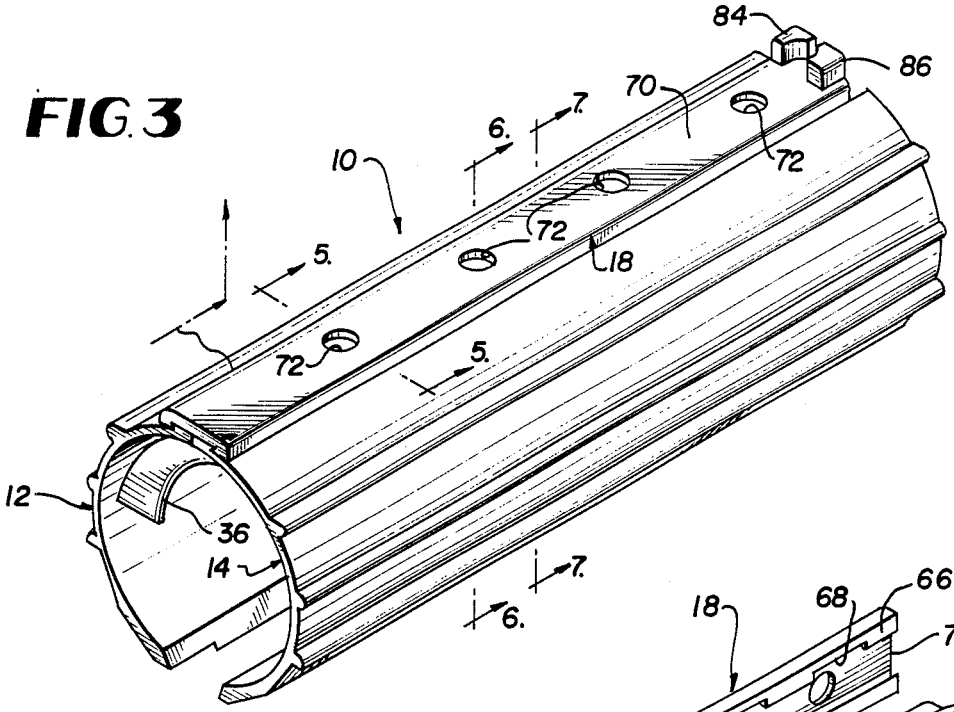
FIG. 3 is a perspective view of the axially elongated hollow housing of the present invention.

Referring initially to FIGS. 1 and 2, an elongated hollow housing assembly 10 is illustrated in accordance with the invention, and includes a pair of housing halves 12 and 14, a first elongated clip 18 for slideably engaging a first dovetail 16 formed by housing halves 12 and 14, and a second elongated clip 22 for slideably engaging a second dovetail 20.

Preferably, housing halves 12 and 14, and first clip 18 are made of a hard plastic material to reduce the cost and weight of the magazine assembly. Clip 22, on the other hand, is preferably made of thin metal. Nevertheless, it will be apparent to those skilled in the art that housing halves 12 and 14, and clips 18 and 22 may be made out of any suitable materials.

The housing assembly 10 is part of a magazine assembly 21 for a gun 23. Various parts of the gun 23 and the manner in which it cooperates with the invention magazine, as well as the internal parts, the workings and the parts of the magazine not shown, are not necessary for an understanding of the present invention. Details can be found in the related patents identified above and incorporated herein by reference.

However, FIG. 2 illustrates some parts of an internal mechanism which can be used with housing assembly 10. These parts include a fluted cartridge carrier 24, a torque spring 26, a rear end cap assembly 28 with a clutch and winder therein, a front end cap 30, a rod 32 that is secured to the rear end cap assembly 28 and a splined driver 34. All of the above are described in full in my prior patents incorporated by reference above.

Referring more particularly now to FIG. 2, the housing halves 12 and 14 each includes a plurality of screw thread segments 36 formed on the inside surface of housing halves 12 and 14. The screw thread segments 36 are positioned so that when housing halves 12 and 14 are assembled together, the segments 36 form a continuous screw thread with a pitch and radial height appropriate to the length and diameter of the particular size of the rounds of ammunition to be stored in the magazine.

Housing half 12 has an upper edge 38 and a lower edge 40 with a plurality of alternating mating pins 42 and mating openings 44 that fit a corresponding plurality of mating pins 42' and mating openings 44' in upper edge 38' or lower edge 40' of housing half 14. The plurality of mating pins 42, 42' and mating openings 44, 44' aid in locating and providing a tight fit between the halves 12 and 14.

Figure 4:
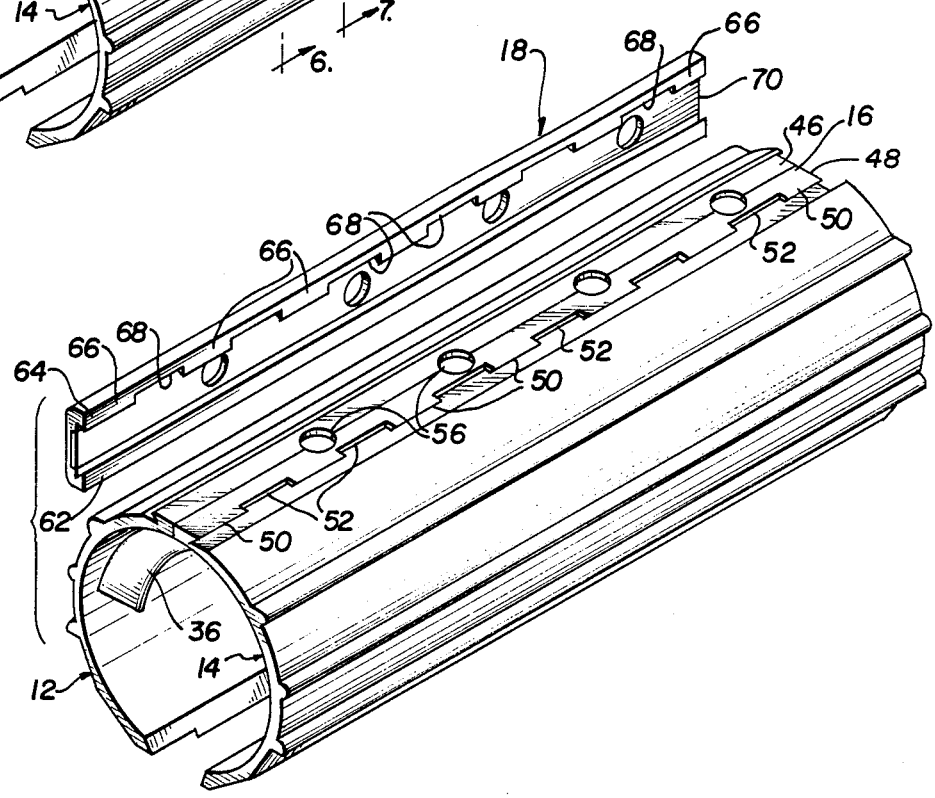
FIG. 4 is a perspective view of the housing showing the elongated clip as removed from the housing.
Figure 5:
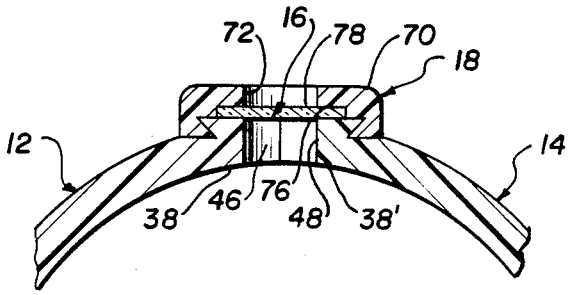
FIG. 5 is a fragmentary cross-sectional view taken on line 5—5 of FIG. 3.

The housing halves 12 and 14 further include retaining flanges or dovetail halves 46 and 48, see FIG. 4, that extend over substantially the entire length of housing halves 12 and 14 adjacent the upper edge 38 and which come together to form upper dovetail 16 in the assembled together condition of the housing.

Preferably, the first dovetail half 46 comprises a continuous dovetail half along the entire length of housing half 12. Dovetail half 48 is segmented, having dovetail or retaining segments 50 spaced longitudinally apart separated by dovetail cutouts 52. Preferably, the dovetail segments 50 are all of equal length and the dovetail cutouts 52 are of equal length and slightly greater in length than the dovetail segments 50.

The housing halves 12 and 14 further include a plurality of complementary semicircular notches 54 that come together to form circular housing openings 56 spaced longitudinally apart along the housing 10 when assembled.

The elongated clip 18 has a first elongated dovetail ledge 62 that fits around the first dovetail half 46 and a second elongated dovetail ledge 64 that fits around the second dovetail half 48. Preferably, the first elongated ledge 62 is continuous. The second elongated ledge 64 is divided into retaining or ledge segments 66 spaced longitudinally apart by ledge cutouts 68. Preferably, the ledge segments 66 are all of equal length and are of the same length as the dovetail segments 50 that make up the dovetail half 48 on the housing half 14 and the ledge cutouts 68 are of equal length and are of the same length as the dovetail cutouts 52.

During assembly or disassembly of the housing, ledge segments 66 can easily slide into the spaces provided by dovetail cutouts 52 and dovetail segments 50 can easily fit into the spaces provided by ledge cutouts 68. The clip 18 can be slid in a longitudinal direction from an unlocked position where the ledge segments 66 are aligned with the dovetail cutouts 52 and dovetail segments 50 are aligned with ledge cutouts 68 to a locked position where ledge segments 66 align with dovetail segments 50. In the unlocked position, the clip 18 can be attached or removed by pivoting the second ledge 64 towards or away from the second dovetail 48. In the locked position, the ledge segments align with and engage the dovetail segments 50, preventing pivotal removal of the clip 18.

The elongated clip 18 has a body portion 70 with a plurality of longitudinally spaced apart circular holes 72 positioned to align with housing openings 56 when housing halves 12 and 14 are assembled together. The body portion 70 has a lower face 74 between the first and second elongated ledges 62 and 64 that includes a recess 76 for receiving an elongated transparent plastic strip 78. The plastic strip 78 is fastened in the recess 76 by glue or other suitable fastening means to lie flush with the lower face 74. The plastic strip 78 runs substantially the entire length of the elongated clip 18. It covers the circular holes 72 and fits over the circular housing openings 56 when clip 18 is assembled on the housing 10.

The clip 18 also includes a pair of upstanding members 84 and 86 spaced latitudinally apart to serve as part of a gunsight. The upstanding members 84 and 86 also assist a user in sliding the clip 18 longitudinally during attachment or removal by serving as a point for gripping or pushing the clip 18 along dovetail 16.

Figure 6:
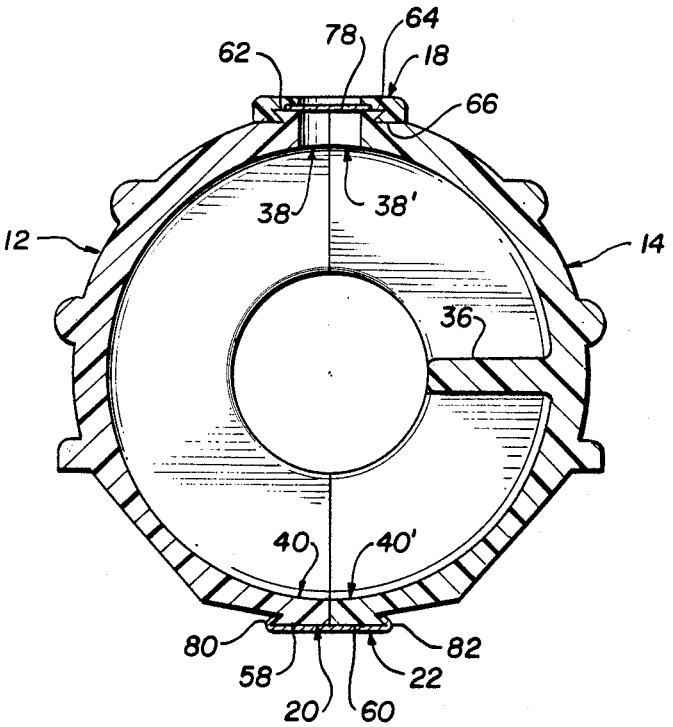
FIGS. 6 and 7 are cross-sectional views taken on lines 6—6 and 7—7 of FIG. 3, respectively.
Figure 7:
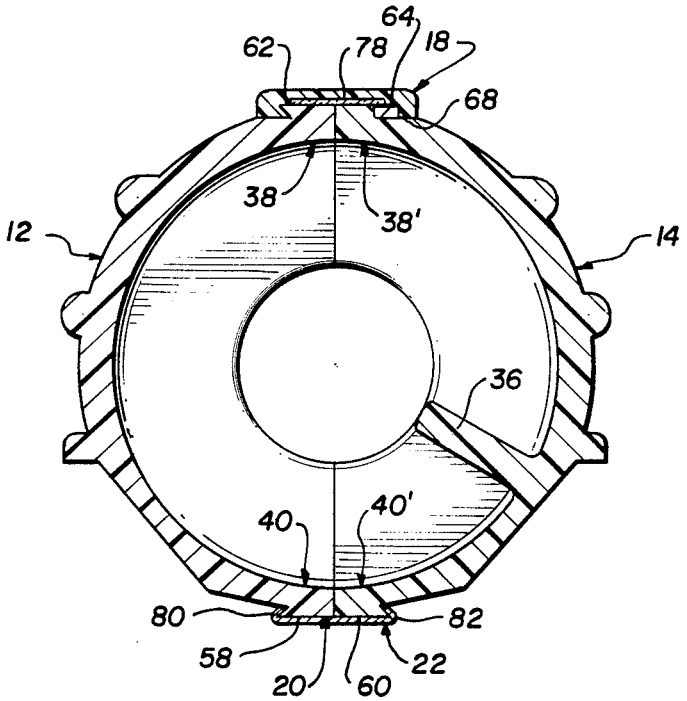

As seen in FIGS. 6 and 7, the lower edges 40 of the housing halves 12 and 14 are releasably joined by the second elongated clip 22. Preferably, housing halves 12 and 14 have lower dovetail halves 58 and 60 to form a lower dovetail 20 on the opposite side of the housing 10 from the upper dovetail 16 when housing halves 12 and 14 are assembled together. A second elongated clip 22 having flanges or ledges 80 and 82 that fit around the second dovetail 20. Of course, it will be apparent to those skilled in the art that clip 22 may be replaced by a hinge or any other suitable fastener for interconnecting the lower edges 40 and 40' of the housing 10 together. Also, as is clear from FIGS. 6 and 7, the vertical line defines a split plane or parting line about which the two halves and the housing overall are symmetrical.

In use, after assembly of the internal parts of the magazine, the housing halves 12 and 14 are fitted together so that upper edges 38 and 38' come together, lower edges 40 and 40' come together, and mating pins 42 enter their respective mating openings 44. The second elongated clip 22 is then slid over the lower dovetail 20 so that the lower edges 40 are held together. This operation can be facilitated if the user first holds the upper ends of the housing halves slightly apart to thus ease fitting the second clip 22 onto its dovetail 20. Then the halves are brought firmly together with clip 22 in place. Then, first elongated clip 18 is put into position by first fitting the first elongated ledge 62 around the first dovetail half 46. The elongated clip 18 may be slid in a longitudinal direction until ledge segments 66 find their respective dovetail cutouts 52 and dovetail segments 50 find their respective ledge cutouts 68 and so that the elongated clip 18 may be pivoted into an aligned position where the lower face 74 of the elongated clip 18 lies flat against the top of the dovetail 16. The elongated clip 18 is then slid in a longitudinal direction so that dovetail segments 50 align with corresponding ledge segments 66 to hold the clip 18 in place. The housing assembly 10 may then be used as a magazine of a gun, as described in the patents incorporated by reference above. Longitudinally spaced housing openings 56 and clip holes 72 allow the user of the gun to view portions of the interior of the housing assembly 10 and determine approximately how much ammunition remains in the magazine.

Disassembly of the housing assembly 10 can be accomplished by sliding the elongated clip 18 in a longitudinal direction until ledge segments 66 align with dovetail cutouts 52 and dovetail segments 50 align with corresponding ledge cutouts 68 allowing the elongated clip 18 to be easily removed from the dovetail 16. Then second clip 22 is removed by sliding it longitudinally along the lower dovetail 20.

This simplicity of assembly and disassembly provides enormous advantages as to economics, ease of manufacture, and speeding repair or other work on the invention magazine, even in the field. That is, if an internal part of the magazine should break or fail or jam, the user could quickly open and repair the magazine himself, in the field.

While the invention has been described in some detail above, it is to be understood that this detailed description is by way of example only, and the protection granted is to be limited only within the spirit of the invention and the scope of the following claims.

What is claimed is:

1. An axially elongated hollow housing assembly for use in an ammunition magazine for a gun, the combination comprising:

first and second elongated housing halves having their outside configuration substantially symmetrical about the longitudinal plane of said housing assembly;

means for releasably coupling said housing halves together comprising:

dovetail means extending longitudinally along substantially the entire length of said housing, said dovetail means comprising a first dovetail half on said first housing half and a second dovetail half on said second housing half, said second housing half having dovetail segments and dovetail cutouts alternating with each other and spaced longitudinally apart, and elongated clip means having a first elongated ledge for slideably engaging said first dovetail half, and a second elongated ledge for slideably engaging said second dovetail half, said second elongated ledge having ledge segments and ledge cutouts alternating with each other and spaced longitudinally apart, said clip means slideably engaging said dovetail means for moving between an unlocked position where said ledge segments are aligned with said dovetail cutouts and said ledge cutouts are aligned with said dovetail segments to allow attachment or detachment of said clip means to said dovetail means, and a locked position where said ledge segments are aligned with said dovetail segments to hold said housing halves in the assembled together condition of said housing.

2. The combination of claim 1, said dovetail segments, said dovetail cutouts, said ledge segments and said ledge cutouts being of substantially equal length.

3. The combination of claim 2, wherein said first dovetail half and said first elongated ledge are substantially continuous.

4. The combination of claim 1, said housing assembly serving as an ammunition magazine, and window means allowing a user to see into said magazine through said window means to determine approximately how many rounds remain in said magazine, said window means comprising a plurality of housing openings in one or both of said housing halves positioned to correspond with openings in said elongated clip means that align with said housing openings in the assembled together condition of said housing assembly, a strip of transparent plastic, and means for positioning said transparent plastic strip between said housing openings and said clip openings so that said strip completely covers said housing openings in the assembled together condition of said housing assembly.

5. The combination of claim 4, said transparent plastic strip positioning means comprising a recess on the underside of said first elongated clip means for receiving said plastic strip.

6. The combination of claim 5 and said transparent plastic strip being glued into said recess.

7. The combination of claim 1, each of said housing halves and said first elongated clip being formed integrally and entirely of molded plastic material.

8. The combination of claim 1, second means for coupling said housing halves together, said second means for coupling said housing halves together comprising:

second dovetail means extending over at least part of the length of said housing opposite said first dovetail means; and second clip means comprising a second elongated clip having a pair of retaining flanges that fit around said second dovetail means, whereby said second clip may be engaged or disengaged from said second dovetail means during assembly or disassembly of said housing assembly.

9. The combination of claim 8, said second elongated clip being formed of metal.

10. The combination of claim 1, further comprising a pair of upstanding portions extending from said first elongated clip forming part of a sight for a gun when said magazine housing is mounted on said gun.

11. In an axially elongated hollow housing assembly for use in an ammunition magazine for a cooperating gun, said hollow housing being of the type comprising a pair of substantially symmetrical housing halves each formed with mating dovetail halves at the longitudinal edges thereof and including mating clip means for removably holding said housing halves together by cooperation with the dovetails formed by said dovetail halves in the assembled together condition of the housing halves, the improvement comprising, alternating and longitudinally substantially equally spaced apart cutouts in at least one dovetail half and one mating clip means, and said cutouts being of substantially equal length to each other and to the remaining not cutout portions of said dovetail half and said clip means, whereby said clip means can be locked or unlocked with respect to said cutout dovetail half by being moved longitudinally on the dovetail formed by said dovetail half a distance substantially equal to the length of a single cutout.

12. The combination of claim 11, wherein said first dovetail half and said first elongated ledge are substantially continuous.

13. The combination of claim 11, said housing assembly serving as an ammunition magazine, and window means allowing a user to see into said magazine through said window means to determine approximately how many rounds remain in said magazine, said window means comprising a plurality of housing openings in one or both of said housing halves positioned to correspond with openings in said elongated clip means that align with said housing openings in the assembled together condition of said housing assembly, a strip of transparent plastic and means for positioning said transparent plastic strip between said housing openings and said clip openings so that said strip completely covers said housing openings in the assembled together condition of said housing assembly.

14. The combination of claim 13, said transparent plastic strip positioning means comprising a recess on the underside of said first elongated clip means for receiving said plastic strip.

15. The combination of claim 14 and said transparent plastic strip being glued into said recess.

16. The combination of claim 11, second means for coupling said housing halves together, said second means for coupling said housing halves together comprising:

second dovetail means extending over at least part of the length of said housing opposite said first dovetail means; and second clip means comprising a second elongated clip having a pair of retaining flanges that fit around said second dovetail means, whereby said second clip may be engaged or disengaged from said second dovetail means during assembly or disassembly of said housing assembly.

17. The combination of claim 16, said second elongated clip being formed of metal.

18. The combination of claim 11, each of said housing halves and said first elongated clip being formed integrally and entirely of molded plastic material.

19. The combination of claim 11, further comprising a pair of upstanding portions extending from said first elongated clip forming part of a sight for a gun when said magazine housing is mounted on said gun.

20. An axially elongated hollow housing assembly for use in an ammunition magazine for a gun, the combination comprising:

first and second housing halves having their outside configuration substantially symmetrical about the longitudinal axis of said housing assembly, each of said housing halves including a plurality of segments of axially inwardly extending screw threads formed on the inside surface thereof, said screw threads being so positioned on their respective housing halves that said segments form a continuous screw thread when said housing halves are assembled together to form said housing, said screw thread segments defining a pitch and a radial height of said continuous screw thread, and said pitch and said radial height being related to the length and the diameter, respectively, of the particular size of the rounds of ammunition to be stored in said magazine so as to permit said rounds to feed in a helical path through said magazine;

first means for releasably coupling said housing halves together, said first joining means including first dovetail means extending longitudinally along substantially the entire length of said housing, said first dovetail means comprising a first substantially continuous dovetail half on said first housing half and a second dovetail half on said second housing half having dovetail segments and dovetail cutouts spaced longitudinally apart and of equal length, first elongated clip means having a first substantially continuous elongated ledge for slideably engaging said first dovetail half, and a second elongated ledge for slideably engaging said second dovetail half, said second elongated ledge having ledge segments and ledge cutouts spaced longitudinally apart and of substantially equal length, said first dovetail means cooperating with said first clip means for moving between an unlocked position where said ledge segments are aligned with said dovetail cutouts and said ledge cutouts are aligned with said dovetail segments to allow attachment or detachment of said first clip means to said first dovetail means, and a locked position where said ledge segments are aligned with said dovetail segments to hold said housing halves in the assembled together condition of said housing assembly;

and second means for releasably coupling said housing halves together comprising:

second dovetail means extending over at least part of the length of said housing opposite said first dovetail means, and second clip means comprising a second elongated clip having a pair of retaining flanges that fit around said second dovetail means, whereby said second clip may be engaged or disengaged from said second dovetail means during assembly or disassembly of said housing assembly;

and window means for permitting viewing of the contents of said housing comprising:

a plurality of complementary semicircular notches in said housing halves that form circular housing openings in the assembled together condition of said housing assembly and corresponding circular clip openings in said elongated clip that align with said circular housing openings in the assembled together condition of said housing assembly; and a strip of transparent plastic and means for positioning said transparent plastic strip between said housing openings and said clip openings so that said strip completely covers said housing openings in the assembled together condition of said housing assembly, said transparent plastic strip positioning means comprising a recess on the underside of said first elongated clip for receiving said plastic strip, and said transparent plastic strip being coupled in said recess.

* * * * *